US009305494B2

(12) United States Patent
Shim et al.

(10) Patent No.: US 9,305,494 B2
(45) Date of Patent: Apr. 5, 2016

(54) ORGANIC LIGHT EMITTING DISPLAY DEVICE AND METHOD FOR DRIVING THE SAME

(71) Applicant: LG DISPLAY CO., LTD., Seoul (KR)

(72) Inventors: Jong Sik Shim, Goyang-si (KR); Na Young Bae, Busan (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/534,937

(22) Filed: Nov. 6, 2014

(65) Prior Publication Data

US 2015/0187276 A1 Jul. 2, 2015

(30) Foreign Application Priority Data

Dec. 30, 2013 (KR) ..... 10-2013-0166471

(51) Int. Cl.
*G09G 3/32* (2006.01)

(52) U.S. Cl.
CPC ..... *G09G 3/3291* (2013.01); *G09G 3/3233* (2013.01); *G09G 2300/0426* (2013.01); *G09G 2300/0814* (2013.01); *G09G 2300/0819* (2013.01); *G09G 2300/0852* (2013.01); *G09G 2310/0251* (2013.01); *G09G 2310/0264* (2013.01); *G09G 2320/0219* (2013.01); *G09G 2320/0233* (2013.01)

(58) Field of Classification Search
CPC ..... G09G 3/3233; G09G 3/3291; G09G 2300/0426; G09G 2300/0814; G09G 2300/0819; G09G 2320/0219; G09G 2310/0251; G09G 2320/0233; G09G 2310/0264; G09G 2300/0852
See application file for complete search history.

(56) References Cited

U.S. PATENT DOCUMENTS

2001/0030323 A1* 10/2001 Ikeda ..... H01L 29/78645 257/59
2006/0061526 A1* 3/2006 Shirasaki ..... G09G 3/3233 345/77
2006/0119548 A1* 6/2006 Lan ..... G09G 3/3233 345/76

(Continued)

FOREIGN PATENT DOCUMENTS

EP 2161706 A2 3/2010
JP 2003224437 A 8/2003

(Continued)

*Primary Examiner* — Premal Patel
(74) *Attorney, Agent, or Firm* — Dentons US LLP

(57) ABSTRACT

An organic light emitting display device includes a display panel having a plurality of pixels, each pixel connected to a data line, a gate line group and a reference line, each pixel further including: an organic light emitting device; a driving transistor controlling a current flowing in the organic light emitting device and including first and second gate electrodes overlapped with each other, with a semiconductor layer provided therebetween; a first switching transistor selectively supplying a data voltage supplied to the data line to a first node connected to the first gate electrode; a second switching transistor selectively supplying a sensing voltage to the second gate electrode; a third switching transistor selectively connecting a second node connected to a source electrode of the driving transistor to the first node; a fourth switching transistor selectively connecting the reference line to the second node; a first capacitor connected between the second gate electrode and the second node, the first capacitor storing a threshold voltage of the driving transistor; and a second capacitor connected between the first and second nodes, the second capacitor storing a difference voltage of the first and second nodes.

20 Claims, 14 Drawing Sheets

(56) References Cited

U.S. PATENT DOCUMENTS

2009/0020761 A1* 1/2009 Okazaki ..... H01L 27/1214 257/66
2010/0053041 A1 3/2010 Abe et al.
2011/0122119 A1* 5/2011 Bae ..... G09G 3/3233 345/211
2011/0148937 A1* 6/2011 Park ..... G09G 3/3233 345/690
2011/0285691 A1 11/2011 Takasugi et al.
2013/0063413 A1* 3/2013 Miyake ..... G09G 3/32 345/212
2013/0069068 A1 3/2013 Miyake
2015/0154906 A1* 6/2015 Chung ..... G09G 3/3233 345/212
2015/0171156 A1 6/2015 Miyake

FOREIGN PATENT DOCUMENTS

JP 2010060816 A 3/2010
JP 2015132816 A 7/2015

* cited by examiner

ORGANIC LIGHT EMITTING DISPLAY DEVICE AND METHOD FOR DRIVING THE SAME

CROSS REFERENCE TO RELATED APPLICATIONS

This application claims the benefit of Korean Patent Application No. 10-2013-0166471, filed on Dec. 30, 2013, which is hereby incorporated by reference for all purposes as if fully set forth herein.

BACKGROUND OF THE INVENTION

1. Field of the Invention

The present invention relates to a flat panel display device, and more particularly, to an organic light emitting display device that includes a thin film transistor.

2. Discussion of the Related Art

Recently, with the development of information society, flat panel display devices having characteristics such as slimness, lightweight, and low power consumption have been in demand. Among various types of flat panel display devices, liquid crystal display devices and organic light emitting display devices, each of which includes an array of thin film transistors, have been widely commercialized as display devices for televisions, notebook computers, tablet computers or desktop computers, owing to their excellent characteristics of resolution, color display and picture quality. Particularly, organic light emitting display device have received much attention as a flat panel display device for the next generation, owning to such advantages as fast response speed, low power consumption, and excellent viewing angle characteristic based on self-light emission.

FIG. 1 is a circuit diagram illustrating a pixel structure of a general organic light emitting display device.

Referring to FIG. 1, a pixel P of the general organic light emitting display device includes a switching transistor Tsw, a driving transistor Tdr, a capacitor Cst, and an organic light emitting device OLED.

The switching transistor Tsw is switched in accordance with a scan pulse SP supplied to a scan line SL and supplies a data voltage Vdata, which is supplied to the data line DL, to the driving transistor Tdr.

The driving transistor Tdr is switched in accordance with the data voltage Vdata supplied from the switching transistor Tsw and controls a data current Ioled flowing from a driving power Evdd, which is supplied from a driving power line, to the organic light emitting device OLED.

The capacitor Cst is connected between gate and source terminals of the driving transistor Tdr, and stores a voltage corresponding to the data voltage Vdata supplied to the gate terminal of the driving transistor Tdr and turns on the driving transistor Tdr at the stored voltage.

The organic light emitting device OLED is electrically connected between the source terminal of the driving transistor Tdr and a cathode line EVss and emits light depending on the data current Ioled supplied from the driving transistor Tdr.

Each pixel P of the aforementioned general organic light emitting display device controls an amount of the data current Ioled flowing in the organic light emitting device OLED and allows the organic light emitting device OLED to emit light through the driving transistor Tdr depending on the data voltage Vdata, thereby displaying a predetermined image.

However, in the general organic light emitting display device, threshold voltages Vth of the transistors Tdr and Tsw, especially the driving transistor Tdr, are different for each pixel due to non-uniformity caused by the manufacturing processes of the thin film transistors.

Accordingly, in the general organic light emitting display device, reliability of the thin film transistors and the display panel deteriorates due to such an initial non-uniformity of the threshold voltages of the thin film transistors included in each pixel or a shift of the threshold voltages according to lapse of time.

SUMMARY OF THE INVENTION

Accordingly, the present invention is directed to an organic light emitting display device and method for driving the same that substantially obviates one or more of the problems due to limitations and disadvantages of the related art.

An advantage of the present invention is to provide an organic light emitting display device and method for driving the same, in which a variation of driving characteristics of driving transistors may be compensated.

Another advantage of the present invention is to provide an organic light emitting display device and method for driving the same, in which reliability and lifespan of switching transistors may be increased due to compensation of driving transistors including compensating threshold voltages of driving transistors.

Other advantage of the present invention is to provide an organic light emitting display device and method for driving the same, in which threshold voltages and/or mobility deviation of driving transistors among pixels may be compensated to improve picture quality.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these objects and other advantages and in accordance with the purpose of the invention, as embodied and broadly described herein, an organic light emitting display device may include a display panel having a plurality of pixels, each pixel connected to a data line, a gate line group and a reference line, each pixel further including: an organic light emitting device; a driving transistor controlling a current flowing in the organic light emitting device and including first and second gate electrodes overlapped with each other, with a semiconductor layer provided therebetween; a first switching transistor selectively supplying a data voltage supplied to the data line to a first node connected to the first gate electrode; a second switching transistor selectively supplying a sensing voltage to the second gate electrode; a third switching transistor selectively connecting a second node connected to a source electrode of the driving transistor to the first node; a fourth switching transistor selectively connecting the reference line to the second node; a first capacitor connected between the second gate electrode and the second node, the first capacitor storing a threshold voltage of the driving transistor; and a second capacitor connected between the first and second nodes, the second capacitor storing a difference voltage of the first and second nodes.

In another aspect of the present invention, an organic light emitting display device may include a pixel connected to a data line, a gate line group and a reference line, the pixel comprising an organic light emitting device; a driving transistor controlling a current flowing in the organic light emitting device and including first and second gate electrodes overlapped with each other by interposing a semiconductor layer therebetween; a first capacitor connected between the second gate electrode and a source electrode of the driving transistor; a second capacitor connected between the first gate electrode and the source electrode; and a switching unit switched in accordance with a control signal supplied to the gate line group, storing a threshold voltage of the driving transistor in the first capacitor, storing a difference voltage of a data voltage supplied to the data line and a reference voltage supplied to the reference line in the second capacitor, and allowing the light emitting device to emit light by driving the driving transistor through voltages of the first and second capacitors.

The switching unit may include a first switching transistor selectively supplying the data voltage supplied to the data line to a first node connected to the first gate electrode; a second switching transistor selectively supplying a sensing voltage to the second gate electrode; a third switching transistor selectively connecting a second node connected to the source electrode of the driving transistor to the first node; and a fourth switching transistor selectively connecting the reference line to the second node.

In still another aspect of the present invention, in a method for driving an organic light emitting display device including a pixel, the pixel including an organic light emitting device, a driving transistor controlling a current flowing in the organic light emitting device and including first and second gate electrodes overlapped with each other by interposing a semiconductor layer therebetween, a first capacitor connected between the second gate electrode and a source electrode of the driving transistor, and a second capacitor connected between the first gate electrode and the source electrode, the method comprises the steps of (A) storing a threshold voltage of the driving transistor in the first capacitor; (B) storing a difference voltage of a data voltage supplied to a data line and a reference voltage supplied to a reference line in the second capacitor; and (C) allowing the organic light emitting device to emit light by driving the driving transistor through voltages of the first and second capacitors.

The step (A) may includes resetting the second capacitor by supplying the reference voltage to each of the first gate electrode and the source electrode while storing a reference voltage of a sensing voltage and the reference voltage in the first capacitor by supplying the sensing voltage to the second gate electrode and supplying the reference voltage to the source electrode; and storing the threshold voltage of the driving transistor in the first capacitor by driving the driving transistor in a source follower mode in accordance with the sensing voltage.

The step (B) may include supplying the data voltage to the first gate electrode; and supplying the reference voltage to the source electrode, and the data voltage supplied to the first gate electrode and the reference voltage supplied to the source electrode may be turned off at the same time or the reference voltage may be turned off earlier than the data voltage.

In further still another aspect of the present invention, in a method for driving an organic light emitting display device including a pixel, the pixel including an organic light emitting device, a driving transistor controlling a current flowing in the organic light emitting device and including first and second gate electrodes overlapped with each other by interposing a semiconductor layer therebetween, a first capacitor connected between the second gate electrode and a source electrode of the driving transistor, and a second capacitor connected between the first gate electrode and the source electrode, the method comprises the steps of (A) resetting the second capacitor by supplying a reference voltage to each of the second gate electrode and the source electrode through a reference line and storing a difference voltage of a sensing voltage and the reference voltage in the first capacitor by supplying the sensing voltage to the first gate electrode; and (B) generating sensing data by sensing the threshold voltage of the driving transistor through the reference line while driving the driving transistor in a source follower mode in accordance with the sensing voltage.

The method may further comprise the steps of (C) generating pixel data by correcting data, which will be supplied to the pixel, on the basis of the sensing data; (D) supplying the reference voltage to the source electrode, converting the pixel data to a data voltage and supplying the converted voltage to the first gate electrode, and storing the voltage in the second capacitor; and (E) allowing the organic light emitting device to emit light by driving the driving transistor through the voltage of the second capacitor. In this case, at the step (D), the reference voltage supplied to the source electrode and the data voltage supplied to the first gate electrode may be turned off at the same time or the reference voltage may be turned off earlier than the data voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Terminologies disclosed in this specification should be understood as follows.

It is to be understood that the singular expression used in this specification may include the plural expression unless defined differently on the context. The terminologies such as "first" and "second" are intended to identify one element from another element, and it is to be understood that the scope of the present invention should not be limited by these terminologies.

Also, it is to be understood that the terminologies such as "include" and "has" are intended so as not to exclude the presence or optional possibility of one or more features, numbers, steps, operations, elements, parts or their combination.

Furthermore, it is to be understood that the terminology "at least one" is intended to include all combinations that may be suggested from one or more related items. For example, "at least one of a first item, a second item and a third item" means combination of all the items that may be suggested from two or more of the first item, the second item and the third item, as well as each of the first item, the second item and the third item.

The terminology "on" disclosed in this specification may mean that an element is formed directly on another element and moreover a third element is interposed between these elements.

Hereinafter, the illustrated embodiments of an organic light emitting display device and method for driving the same according to the present invention will be described with reference to the accompanying drawing.

Figure 1:
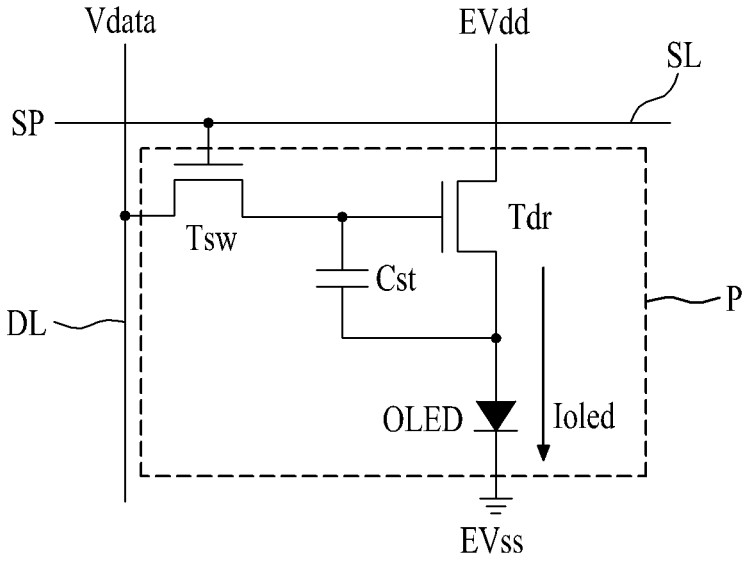
FIG. 1 Related Art
FIG. 1 is a circuit diagram illustrating a pixel structure of a general organic light emitting display device.
Figure 2:
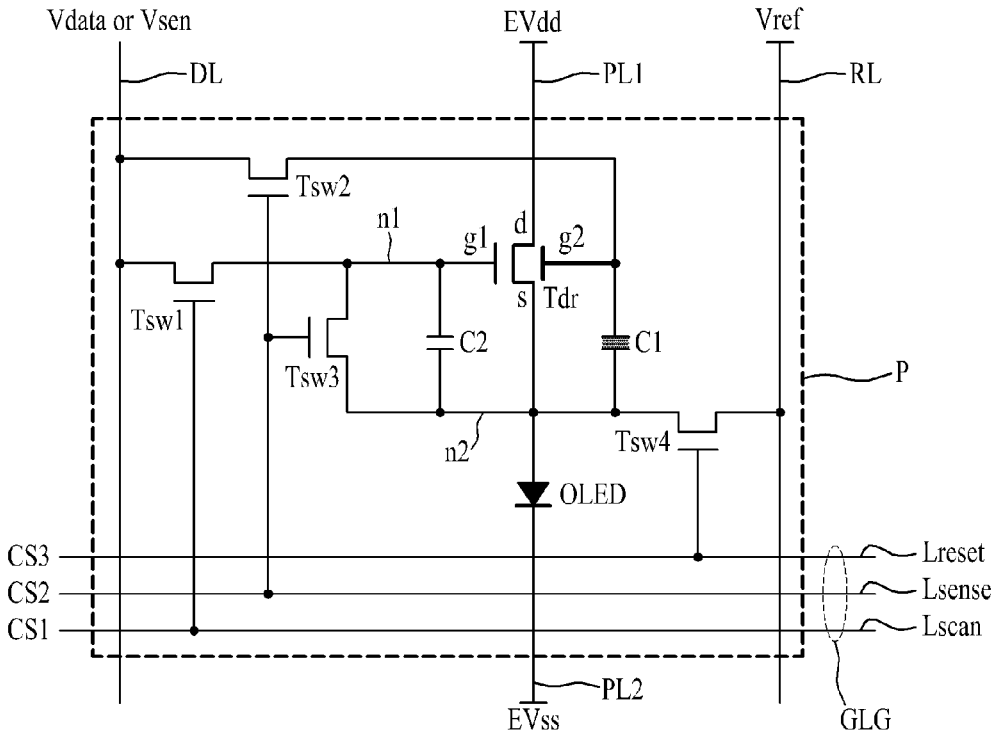
FIG. 2 is a diagram illustrating a pixel structure of an organic light emitting display device according to the first embodiment of the present invention.
Figure 3:
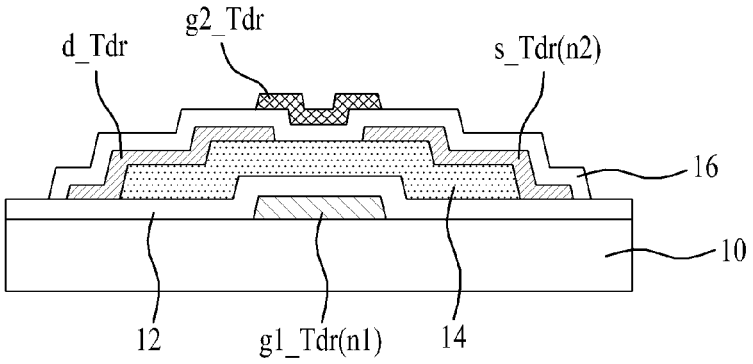
FIG. 3 is a cross-sectional view illustrating a structure of a driving transistor shown in FIG. 2.

FIG. 2 is a circuit diagram illustrating a pixel structure of an organic light emitting display device according to the first embodiment of the present invention. FIG. 3 is a cross-sectional view illustrating a structure of a driving transistor shown in FIG. 2

Referring to FIGS. 2 and 3, a pixel P is connected to a data line DL, a gate line group GLG, a reference line RL, a first driving power line PL1, and a second driving power line PL2.

The data line DL is formed along a first direction of a display panel (not shown), for example, a vertical direction. A data voltage Vdata from a data driver (not shown) is supplied to the data line DL.

The gate line group GLG is formed along a second direction of the display panel, for example, a horizontal direction to cross the data line DL. The gate line group GLG includes a scan control line Lscan, a sensing control line Lsense, and a reset control line Lreset.

The reference line RL is formed to be parallel with the data line DL. The reference line RL may selectively be connected to a reference power line to which a reference voltage Vref of a constant direct current level is supplied, or may be connected to a sensing unit, which will be described later, or may become a floating state.

The first driving power line PL1 is formed to be parallel with the data line DL, and an external high potential voltage EVdd is supplied thereto.

The second driving power line PL2 is formed in the form of wholly or a line to be connected to an organic light emitting device, and an external low potential voltage EVss is supplied thereto.

The pixel P may be a red pixel, a green pixel, a blue pixel or a white pixel. The pixel P includes an organic light emitting device OLED, a driving transistor Tdr, first to fourth switching transistors Tsw1, Tsw2, Tsw3 and Tsw4, and first and second capacitors C1 and C2. Each of the transistors Tsw1, Tsw2, Tsw3, Tsw4 and Tdr may be an N-type thin film transistor TFT, and their examples may include a-Si TFT, poly-Si TFT, Oxide TFT, and organic TFT.

The organic light emitting device OLED is connected between the first driving power line PL1 to which a high potential voltage EVdd is supplied and the second driving power line PL2 to which a low potential voltage EVss is supplied. This organic light emitting device OLED includes an anode electrode connected to a second node n2 which is a source electrode of the driving transistor Tdr, an organic layer (not shown) formed on the anode electrode, and a cathode electrode connected to the organic layer. At this time, the organic layer may be formed to have a structure of hole transporting layer/organic light emitting layer/electron transporting layer or a structure of hole injecting layer/hole transporting layer/organic light emitting layer/electron transporting layer/electron injecting layer. Moreover, the organic layer may further include additional function layers for improving light emitting efficiency and/or lifespan of the organic light emitting layer. The cathode electrode is connected to the second driving power line PL2 formed per pixel column or pixel row along a longitudinal direction of the gate line group GLG or the data line DL or formed to be commonly connected to all the pixels P. This organic light emitting device OLED emits light depending on a current flowing from the first driving power line PL1 to the second driving power line PL2 through the driving transistor Tdr.

The driving transistor Tdr is connected between the first driving power line PL1 and the anode electrode of the organic light emitting device OLED and controls an amount of current flowing in the organic light emitting device OLED in accordance with a voltage between gate and source electrodes of the driving transistor Tdr. To this end, the driving transistor Tdr includes a first gate electrode g1_Tdr, a gate insulating layer 12, a semiconductor layer 14, a source electrode s_Tdr, a drain electrode d_Tdr, a passivation layer 16, and a second gate electrode g2_Tdr.

The first gate electrode g1_Tdr is formed on an array substrate 10 of the display panel.

The gate insulating layer 12 is formed on the array substrate 10 to cover the first gate electrode g1_Tdr. The semiconductor layer 14 is formed on the gate insulating layer 12 to overlap the first gate electrode g1_Tdr. The semiconductor layer 14 may be made of amorphous silicon a-Si, polysilicon poly-Si, oxide, or an organic material. In this case, the oxide semiconductor layer may be made of an oxide such as zinc oxide, tin oxide, Ga—In—Zn oxide, In—Zn oxide or In—Sn oxide, or may be made of the oxide doped with ions of Al, Ni, Cu, Ta, Mo, Zr, V, Hr or Ti.

The source electrode s_Tdr is formed at one side region of the semiconductor layer 14 overlapped with the first gate electrode g1_Tdr. The drain electrode d_Tdr is formed at the other side region of the semiconductor layer 14 overlapped with the first gate electrode g1_Tdr while being spaced apart from the source electrode s_Tdr.

The passivation layer 16 is formed on the array substrate 10 to cover the semiconductor layer 14 and the source and drain electrodes s_Tdr and d_Tdr.

The second gate electrode g2_Tdr is formed on the passivation layer 16 to overlap a part of the first gate electrode g1_Tdr or an entire first gate electrode g1_Tdr, wherein the semiconductor layer 14 is interposed between the second gate electrode g2_Tdr and the first gate electrode g1_Tdr.

A threshold voltage of the driving transistor Tdr can be shifted due to a voltage applied to the first gate electrode g1_Tdr and the second gate electrode g2_Tdr, which are overlapped with each other, with the semiconductor layer 14 provided therebetween.

In more detail, the driving transistor Tdr, which includes both the first gate electrode g1_Tdr and the second gate electrode g2_Tdr, is characterized in that its gate-source voltage Vgs is lowered if a high voltage is applied to the second gate electrode g2_Tdr and its threshold voltage Vth is lowered if the second gate voltage has a high voltage level. Accordingly, the threshold voltage Vth of the driving transistor Tdr is shifted to have a negative correlation with respect to the voltage supplied to the second gate electrode g2_Tdr.

Referring back to FIGS. 2 and 3, the first switching transistor Tsw1 is turned on by a scan control signal CS1 supplied to the scan control line Lscan and supplies the data voltage Vdata supplied to the data line DL to the first node n1 connected to the first gate electrode g1_Tdr of the driving transistor Tdr. To this end, the first switching transistor Tsw1 includes a gate electrode connected to the scan control line Lscan, a first electrode connected to the data line DL, and a second electrode connected to the first node n1. In this case, the first and second electrodes of the first switching transistor Tsw1 may respectively be a source electrode or drain electrode depending on a direction of current flow.

The second switching transistor Tsw2 is turned on by a sensing control signal CS2 supplied to the sensing control line Lsense and supplies a sensing voltage Vdata-sen supplied to the data line DL to the second gate electrode g2_Tdr of the driving transistor Tdr. To this end, the second switching transistor Tsw2 includes a gate electrode connected to the sensing control line Lsense, a first electrode connected to the data line DL, and a second electrode connected to the second gate electrode g2_Tdr of the driving transistor Tdr. In this case, the first and second electrodes of the second switching transistor Tsw2 may respectively be a source electrode or drain electrode depending on a direction of current flow.

The third switching transistor Tsw3 is turned on by the sensing control signal CS2 supplied to the sensing control line Lsense and connects a second node n2, which is connected to the source electrode s_Tdr of the driving transistor Tdr, with the first node n1. In other words, the third switching transistor Tsw3 selectively connects the first gate electrode g1_Tdr of the driving transistor Tdr to the source electrode s_Tdr. To this end, the third switching transistor Tsw3 includes a gate electrode connected to the sensing control line Lsense, a first electrode connected to the first node n1, and a second electrode connected to the second node n2. In this case, the first and second electrodes of the third switching transistor Tsw3 may respectively be a source electrode or drain electrode depending on a direction of current flow.

The fourth switching transistor Tsw4 is turned on by a reset control signal CS3 supplied to the reset control line Lreset and connects the reference line RL with the second node n2. To this end, the fourth switching transistor Tsw4 includes a gate electrode connected to the reset control line Lreset, a first electrode connected to the reference line RL, and a second electrode connected to the second node n2. In this case, the first and second electrodes of the fourth switching transistor Tsw4 may respectively be a source electrode or drain electrode depending on a direction of current flow.

The first capacitor C1 is connected between the second gate electrode g2_Tdr of the driving transistor Tdr and the second node n2 and stores the gate-source voltage of the driving transistor Tdr, that is, the threshold voltage Vth in accordance with switching of the second switching transistor Tsw2. To this end, a first electrode of the first capacitor C1 is connected to the second gate electrode g2_Tdr of the driving transistor Tdr, and a second electrode of the first capacitor C1 is connected to the second node n2.

The second capacitor C2 is connected between the first node n1 and the second node n2, and stores the data voltage Vdata supplied to the data line DL in accordance with switching of the first to third switching transistors Tsw1, Tsw2 and Tsw3 and drives the driving transistor Tdr at the stored voltage. To this end, a first electrode of the second capacitor C2 is connected to the first node n1, and a second electrode of the second capacitor C2 is connected to the second node n2.

The aforementioned first to fourth switching transistors Tsw1, Tsw2, Tsw3 and Tsw4 include a switching unit that allows the organic light emitting device OLED to emit light depending on an amount of current determined by a difference voltage Vdata-Vref between the data voltage Vdata for display and the reference voltage Vref. In other words, the switching unit is switched in accordance with the control signals CS1, CS2 and CS3 supplied to the gate line group GLG, stores the threshold voltage of the driving transistor Tdr in the first capacitor C1, stores the difference voltage Vdata-Vref between the data voltage Vdata for display and the reference voltage Vref, and then allows the organic light emitting device OLED to emit light depending on an amount of current determined by the difference voltage Vdata-Vref between the data voltage Vdata for display and the reference voltage Vref by using the voltages stored in the first and second capacitors C1 and C2. Accordingly, the pixel P according to the first embodiment of the present invention may compensate a shift of the threshold voltage of the driving transistor Tdr.

The pixel P according to the first embodiment of the present invention may be driven in an internal compensation mode or an external compensation mode.

The internal compensation mode is a driving mode that automatically compensates the threshold voltage Vth and mobility of the driving transistor Tdr in accordance with switching of the first to fourth switching transistors Tsw1, Tsw2, Tsw3 and Tsw4, and may include a threshold voltage sensing driving through sensing of the threshold voltage Vth of the driving transistor Tdr and an internal compensation driving. In this case, the threshold voltage sensing driving may be performed for, but not limited to, at least one horizontal line every vertical blank period. The vertical blank period may be set to overlap a blank period of a vertical synchronization signal, or may be set to overlap the blank period of the vertical synchronization signal at a period between a final data enable signal of a previous frame and a first data enable signal of a current frame.

The external compensation mode is a driving mode that senses and compensates the threshold voltage Vth of the driving transistor Tdr of the pixel through the reference line RL, and may include an external sensing driving for generating sensing data by sensing the threshold voltage of the driving transistor Tdr through the reference line RL and an external compensation driving for compensating the threshold voltage of the driving transistor Tdr by correcting input data in accordance with the sensing data sensed by the external sensing driving. In this case, the external sensing driving may be performed for a plurality of frames in such a way to sense at least one horizontal line per setting of a user, vertical blank period or set period (or time), or may be performed sequentially for all the horizontal lines within at least one frame per power on period of the organic light emitting display device, power off period of the organic light emitting display device, power on period after set driving time or power off period after set driving time.

Figure 4A:
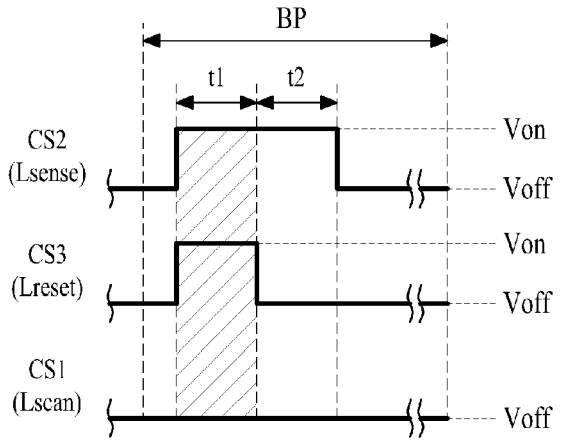
FIGS. 4A to 4C are diagrams illustrating a threshold voltage sensing driving of a pixel in an internal compensation mode of an organic light emitting display device according to an embodiment of the present invention.
Figure 4A:
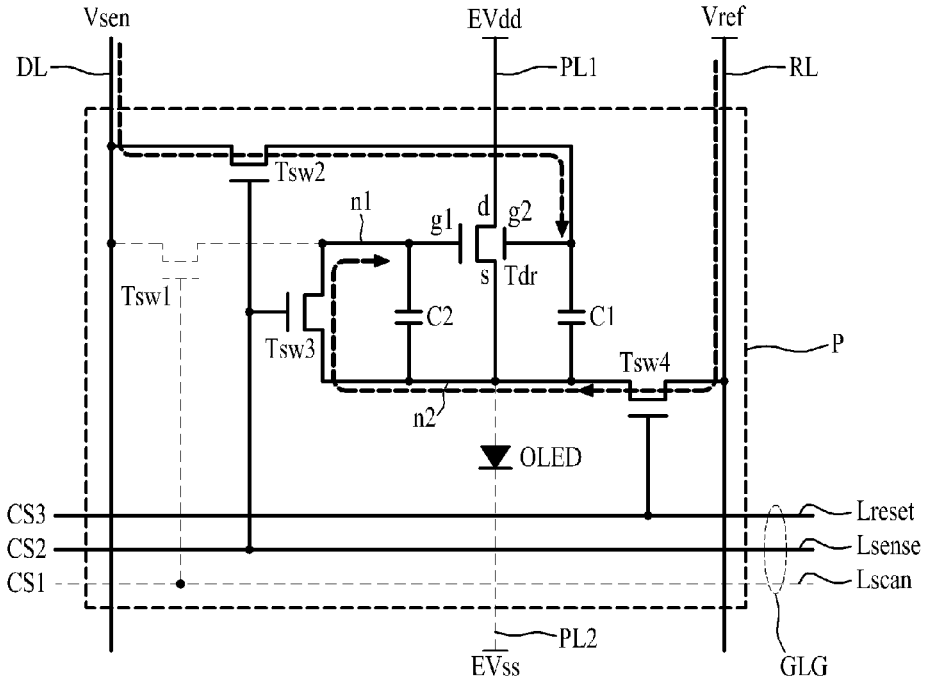
Figure 4B:
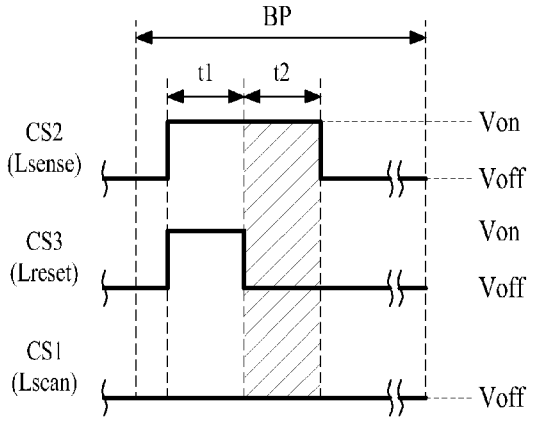
Figure 4B:
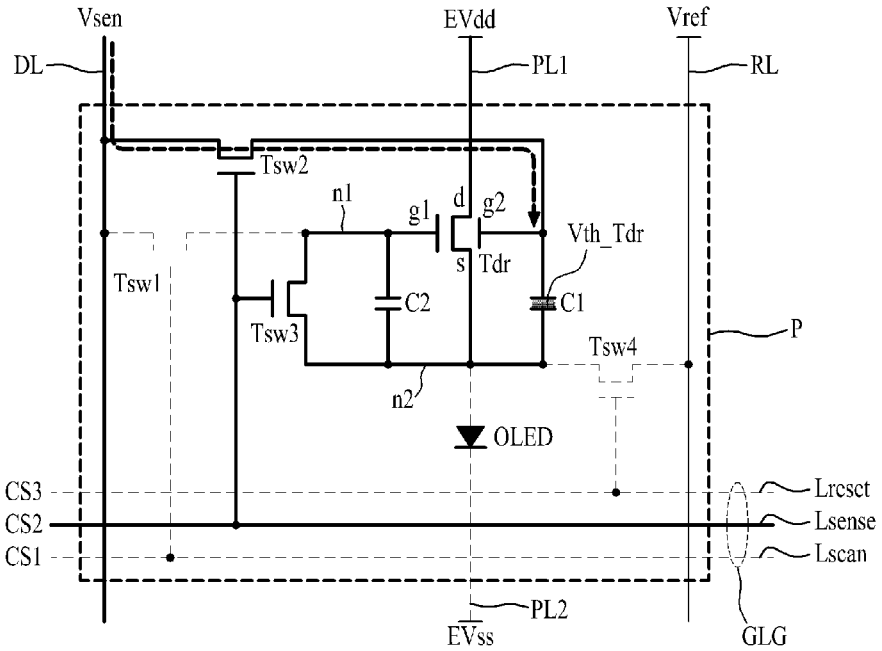
Figure 4C:
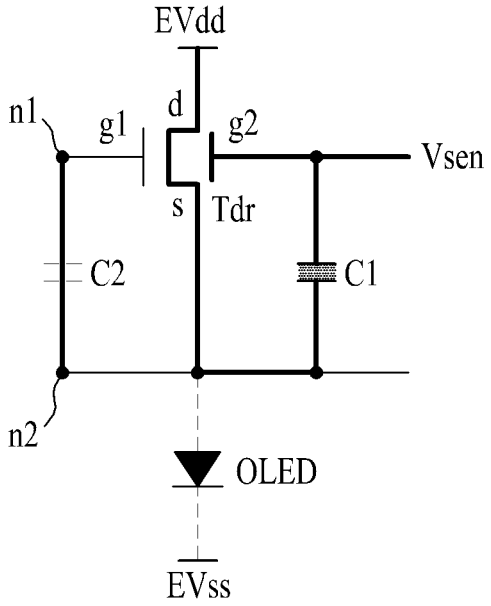
Figure 4C:
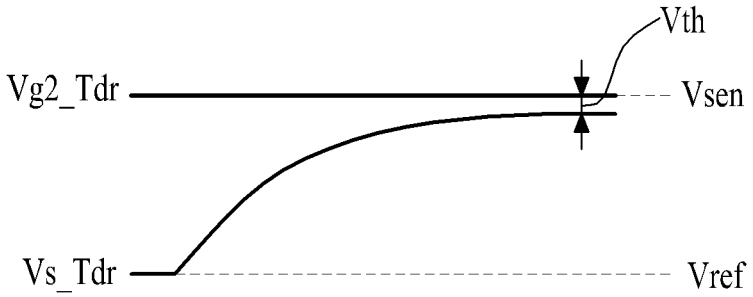

FIGS. 4A to 4C are diagrams illustrating a threshold voltage sensing driving of a pixel in an internal compensation mode of an organic light emitting display device according to an embodiment of the present invention.

A threshold voltage sensing driving of a pixel according to the first embodiment of the present invention will be described with reference to FIGS. 4A to 4C. The pixel P may be driven for a reset period t1 and a detection period t2 in accordance with the threshold voltage sensing driving.

First of all, as shown in FIG. 4*a*, during the reset period t1, the first switching transistor Tsw1 is turned off by a scan control signal CS1 of a gate off voltage Voff, the second and third switching transistors Tsw2 and Tsw3 are turned on by a sensing control signal CS2 of a gate on voltage Von, and the fourth switching transistor Tsw4 is turned on by a reset control signal CS3 of the gate on voltage Von. At this time, a sensing voltage Vsen is supplied to the data line DL, and a reference voltage Vref is supplied to the reference line RL. In this case, the sensing voltage Vsen may have a bias voltage level for driving the driving transistor Tdr in a source follower mode, and the reference voltage Vref may have a voltage level in the range of about 0V to about 1V.

During the reset period t1, since the reference voltage Vref is supplied to the first and second nodes n1 and n2, the voltage of the second capacitor C2 is reset to the reference voltage Vref. Also, since the sensing voltage Vsen is supplied to the second gate electrode g2_Tdr of the driving transistor Tdr, the first capacitor C1 is reset to a difference voltage Vsen-Vref between the sensing voltage Vsen and the reference voltage Vref. At this time, the organic light emitting device OLED does not emit light because the reference voltage Vref is supplied to the second node n2 through the fourth switching transistor Tsw4.

Subsequently, as shown in FIG. 4*b*, during the internal sensing period t2, the turned-off state of the first switching transistor Tsw1 is maintained, the turned-on state of the second and third switching transistors Tsw2 and Tsw3 is maintained, and the fourth switching transistor Tsw4 is turned off by the reset control signal CS3 of a gate off voltage Voff. At this time, the sensing voltage Vsen continues to be supplied to the data line DL.

During the internal sensing period t2, as the fourth switching transistor Tsw4 is turned off, as shown in FIG. 4C, the driving transistor is driven by the sensing voltage Vsen supplied to the second gate electrode g2_Tdr in a source follower mode, whereby a voltage corresponding to the threshold voltage Vth of the driving transistor Tdr is stored in the first capacitor C1. In other words, when the fourth switching transistor Tsw4 is turned off, a current flows in the driving transistor Tdr, whereby the voltage of the second node n2, which is a source voltage Vs_Tdr of the driving transistor Tdr, is increased towards the voltage level of the sensing voltage Vsen supplied to the second gate electrode g2_Tdr of the driving transistor Tdr. In this case, the voltage of the second node n2 is increased until charges equivalent to the threshold voltage Vth of the driving transistor Tdr are charged in the first capacitor C1.

During the internal sensing period t2, the threshold voltage Vth of the driving transistor Tdr, which is stored in the first capacitor C1, is maintained until the threshold voltage Vth is reset by a reset period t1 of the next threshold voltage sensing driving.

Figure 5A:
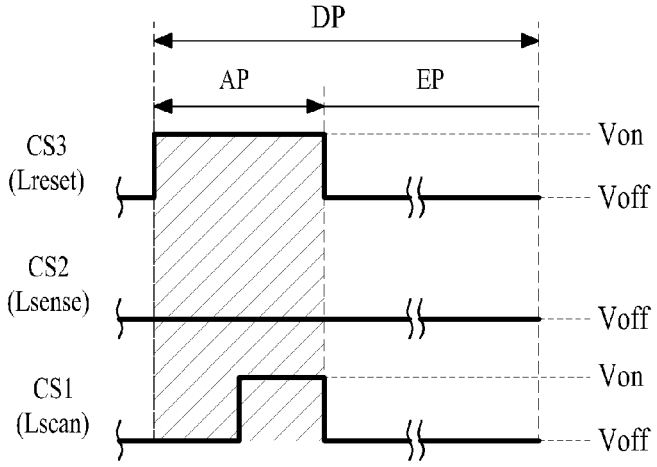
FIGS. 5A to 5C are diagrams illustrating an internal compensation driving of a pixel in an internal compensation mode of an organic light emitting display device according to an embodiment of the present invention.
Figure 5A:
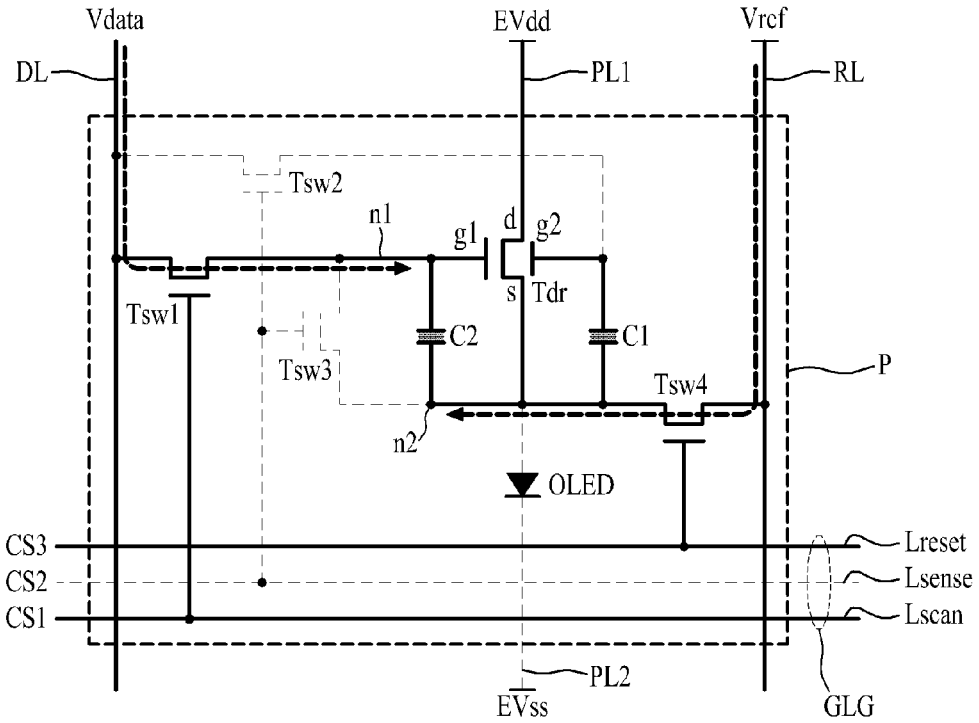
Figure 5B:
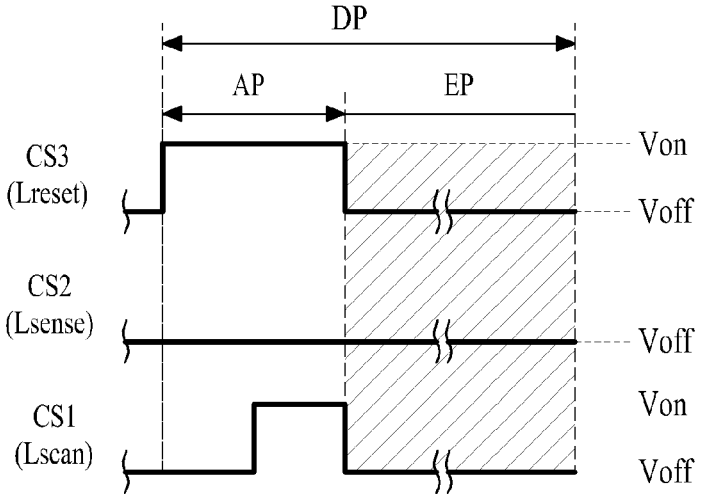
Figure 5B:
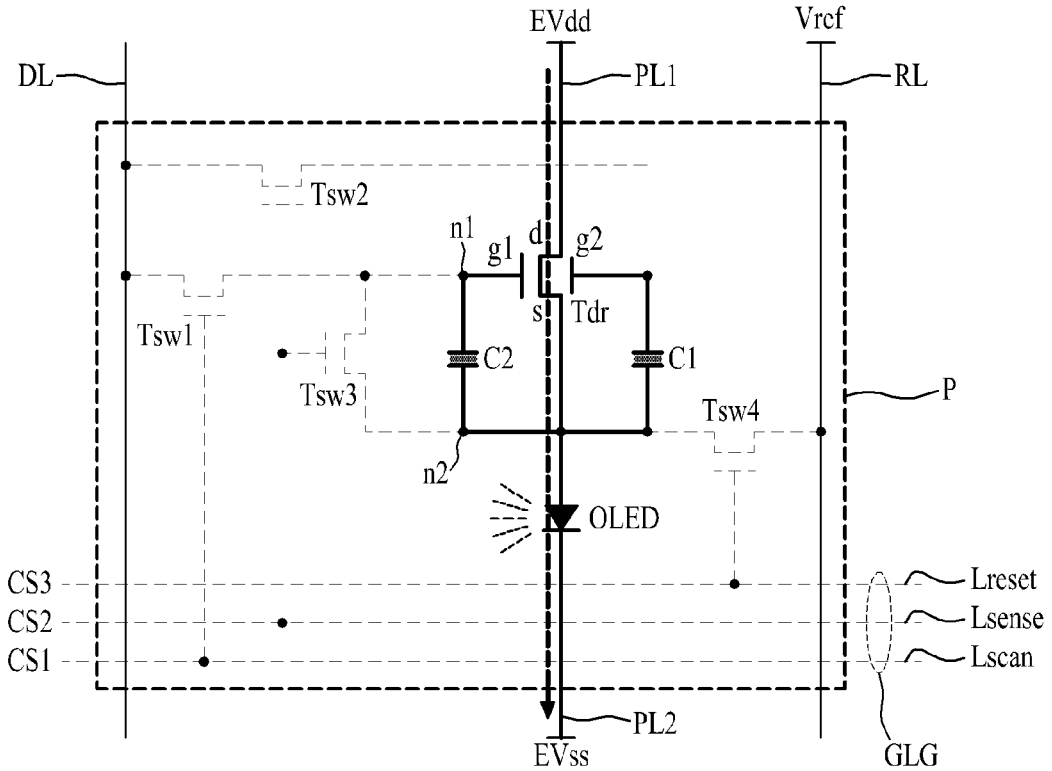
Figure 5C:
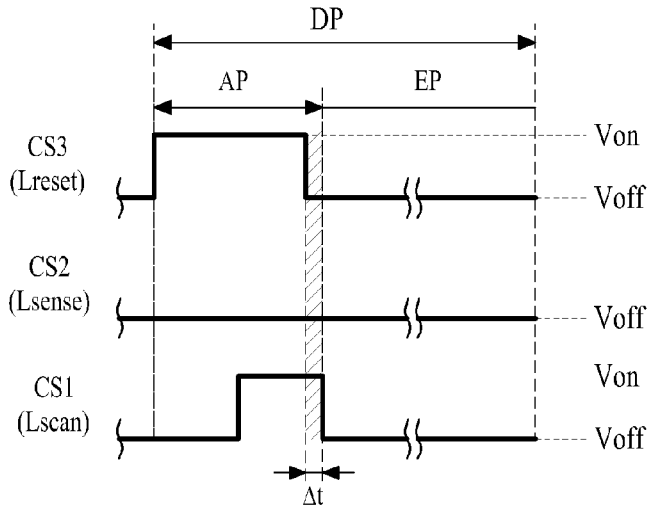
Figure 5C:
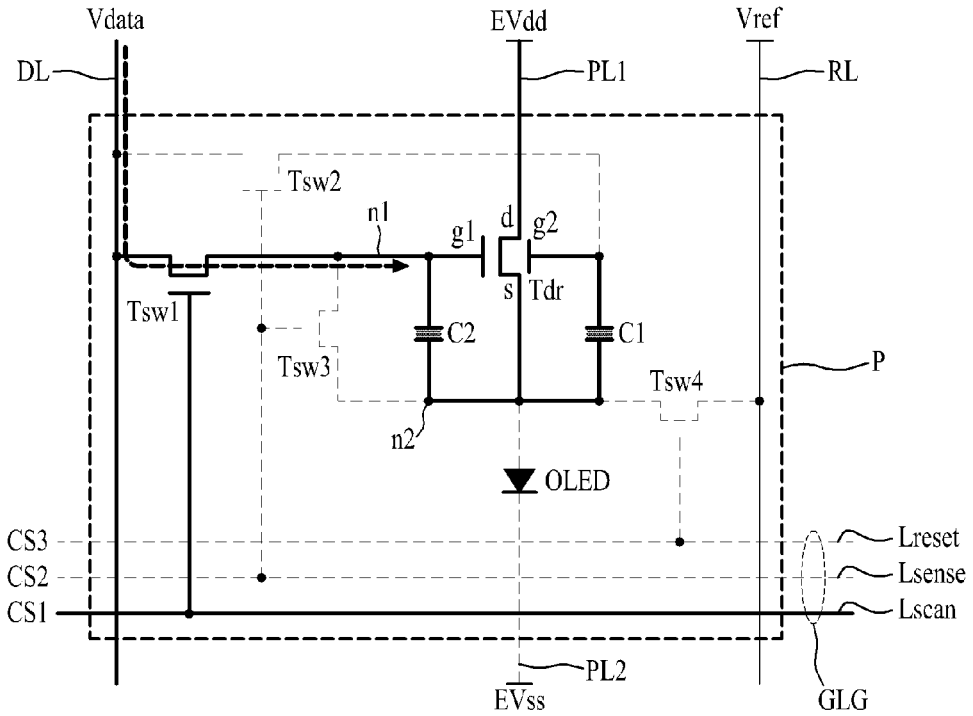

FIGS. 5A to 5C are diagrams illustrating an internal compensation driving of a pixel in an internal compensation mode of an organic light emitting display device according to an embodiment of the present invention.

An internal compensation driving of a pixel according to the first embodiment of the present invention will be described with reference to FIGS. 5A to 5C. The pixel P may be driven for a data addressing period AP and a light emitting period EP in accordance with the internal compensation driving.

First of all, as shown in FIG. 5*a*, for the data addressing period AP, the second and third switching transistors Tsw2 and Tsw3 are turned off by a sensing control signal CS2 of a gate off voltage Voff, the fourth switching transistor Tsw4 is turned on by a reset control signal CS3 of a gate on voltage Von, and the first switching transistor Tsw1 is turned on by a scan control signal CS1 of a gate on voltage Von. At this time, to reduce or prevent the organic light emitting device OLED from emitting light during the data addressing period AP, the first switching transistor Tsw1 is turned on after a constant time passes from the time when the fourth switching transistor Tsw4 is turned on. And, a data voltage Vdata for display is supplied to the data line DL, and a reference voltage Vref is supplied to the reference line RL. The reference voltage Vref has a reference voltage level to allow the organic light emitting device OLED to be normally operated to emit light.

During the data addressing period AP, since the data voltage Vdata for display is supplied to the first node n1 and the reference voltage Vref is supplied to the second node n2, a difference voltage Vdata-Vref between the data voltage Vdata for display and the reference voltage Vref is stored in the second capacitor C2. At this time, as the fourth switching transistor Tsw4 is turned on, the voltage of the second node n2 is shifted to the reference voltage Vref, whereby the voltage of the second gate electrode g2_Tdr of the driving transistor Tdr is also shifted as much as the voltage shift of the second node n2. As a result, the voltage stored in the first capacitor C1 is maintained without being shifted.

Subsequently, as shown in FIG. 5B, during the light emitting period EP, the turned-off state of the second and third switching transistors Tsw2 and Tsw3 is maintained, and the first and fourth switching transistors Tsw1 and Tsw4 are turned off by the control signals CS1 and CS3 of the corresponding gate off voltage Voff at the same time.

Subsequently, during the light emitting period EP, as the first and fourth switching transistors Tsw1 and Tsw4 are turned off, the driving transistor Tdr is driven by the voltage Vth stored in the first capacitor C1 and the voltage Vdata-Vref stored in the second capacitor C2, whereby a current flows from a first driving power line PL1 to a second driving power line PL2, and the organic light emitting device OLED emits light in proportion to the current. The voltage of the second node n2 is increased by the current flowing as the organic light emitting device OLED emits light, and the voltage of the first node n1 is increased as much as a voltage increase of the second node n2, whereby the gate-source voltage Vgs of the driving transistor Tdr is sustained by the voltage of the second capacitor C2. As a result, the organic light emitting device OLED continues to emit light until the data addressing period AP of the next frame.

During the aforementioned light emitting period EP, as the driving transistor Tdr is driven by the voltages Vdata-Vref and Vth stored in the first and second capacitors C1 and C2, the organic light emitting device OLED emits light depending on an amount of current Ids_Tdr of the driving transistor Tdr determined by the difference voltage Vdata-Vref between the data voltage Vdata and the reference voltage Vref, which can be expressed by the following Equation 1.

$$\begin{aligned} Ids_Tdr &= \frac{K \times Cox \times W/L}{2} \times (Vgs - Vth)^2 \\ &= \frac{K \times Cox \times W/L}{2} \times ((Vdata - Vref) + Vth) - Vth)^2 \\ &= \frac{K \times Cox \times W/L}{2} \times (Vdata - Vref)^2 \end{aligned} \quad \text{[Equation 1]}$$

In Equation 1, "K" is mobility of holes or electrons, "Cox" is capacitance of the insulating film, and "W/L" is a ratio of a channel width W and a channel length L of the driving transistor Tdr.

As shown in Equation 1, according to the internal compensation driving of the pixel P according to the first embodiment of the present invention, the current Ids of the driving transistor Tdr is determined by the difference voltage Vdata-Vref between the data voltage Vdata and the reference voltage Vref without being affected by its threshold voltage Vth during the light emitting period EP.

Additionally, during the data addressing period AP, the first and fourth switching transistors Tsw1 and Tsw4 are turned off at the same time, whereas the first and fourth switching transistors Tsw1 and Tsw4 may not be turned off at the same time, and the fourth switching transistor Tsw4 may first be turned off as early as a set time difference Δt, as illustrated in FIG. 5*c*. In other words, the compensation driving of the pixel P according to the first embodiment of the present invention is performed in such a manner that the fourth switching transistor Tsw4 is first turned off during the data addressing period AP and then the first switching transistor Tsw1 is turned off after the set time difference Δt to compensate a variation of mobility characteristics of the driving transistor Tdr.

In more detail, when the fourth switching transistor Tsw4 is first turned off in a state that the first switching transistor Tsw1 is turned on, the source voltage Vs_Tdr of the driving transistor Tdr is increased by mobility K of the driving transistor Tdr based on the data voltage Vdata for display. The gate-source voltage Vgs of the driving transistor Tdr is reduced by an increase of the source voltage Vs_Tdr, whereby the current flowing in the organic light emitting device OLED is reduced. Accordingly, according to another method for driving a pixel as illustrated in FIG. 5*c*, during the data addressing period AP, timings of the scan control signal CS1 and the reset control signal CS3 vary, whereby the fourth switching transistor Tsw4 is turned off earlier than the first switching transistor Tsw1 to compensate mobility K characteristic of the driving transistor Tdr.

Figure 6A:
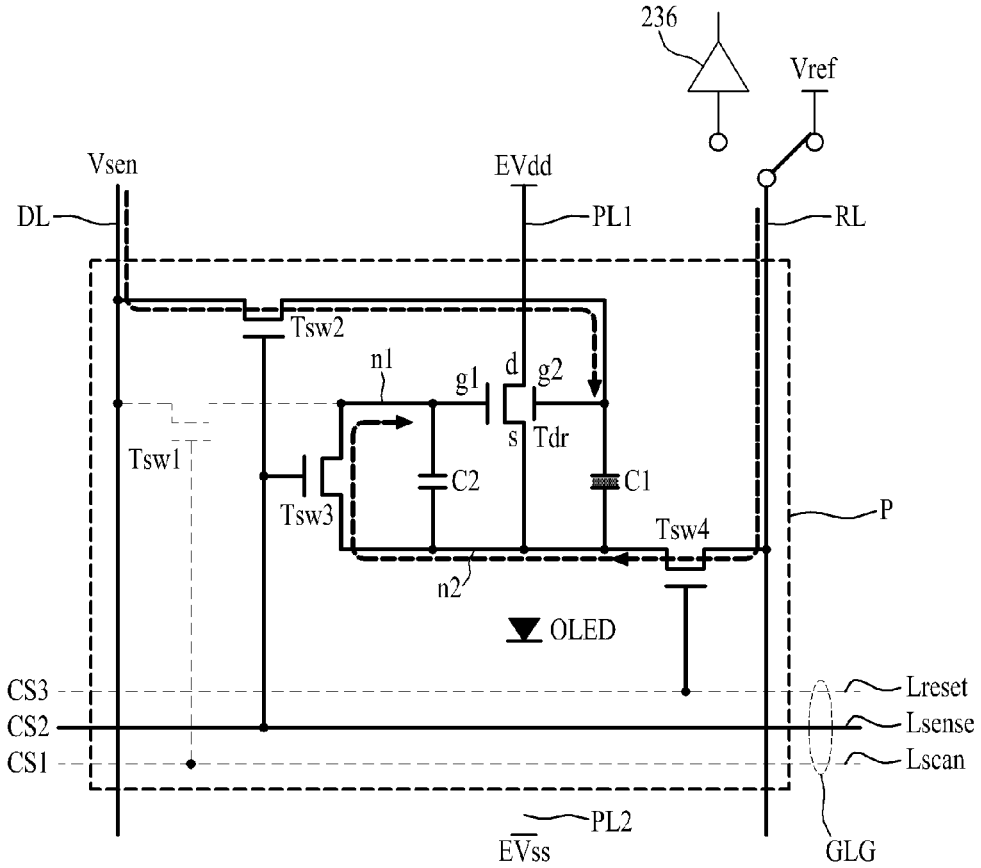
FIGS. 6A and 6B are diagrams illustrating an external sensing driving of a pixel in an external compensation mode of an organic light emitting display device according to an embodiment of the present invention.
Figure 6A:
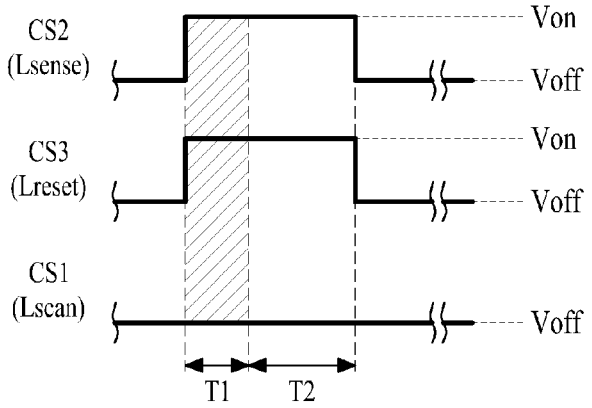
Figure 6B:
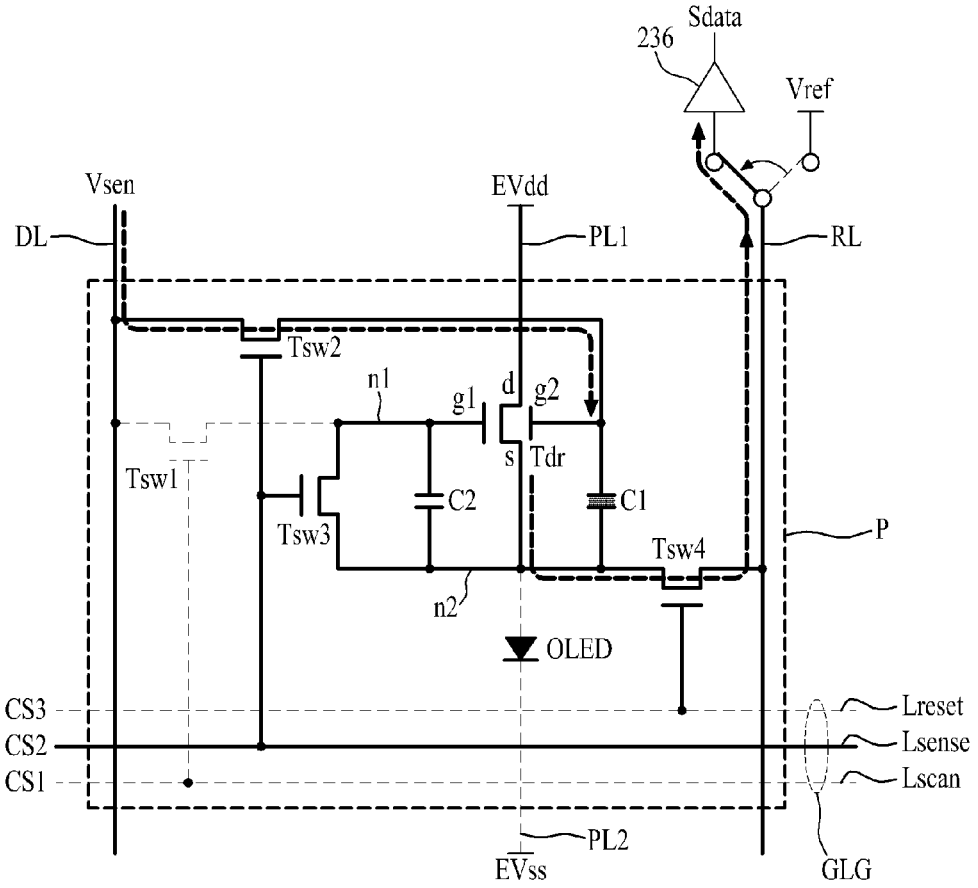
Figure 6B:
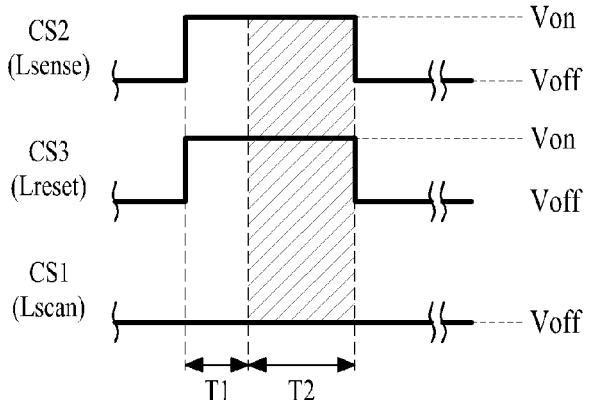

FIGS. 6A and 6B are diagrams illustrating an external sensing driving of a pixel in an external compensation mode of an organic light emitting display device according to an embodiment of the present invention.

An external sensing driving of the pixel according to the first embodiment of the present invention will be described with reference to FIGS. 6A and 6B. The pixel P according to the first embodiment of the present invention may be driven during a reset period T1 and an external sensing period T2 according to the external sensing driving.

First of all, as shown in FIG. 6A, since the reset period T1 is the same as that shown in FIG. 4A, its repeated description will be omitted.

Subsequently, as shown in FIG. 6*b*, during the external sensing period t2, each of the first to fourth switching transistors Tsw1 to Tsw4 maintains the switching state of the reset period T1, and in a state that the sensing data voltage Vsen continues to be supplied to the second gate electrode g2_Tdr of the driving transistor Tdr, the reference line RL is connected to an external sensing unit 236. In this case, the reference line RL may be connected to the sensing unit 236 after maintaining a floating state for a constant time.

Accordingly, during the external sensing period t2, as the driving transistor Tdr is operated in a source follower mode by the sensing data voltage Vsen supplied to second gate electrode g2_Tdr, the voltage corresponding to the current flowing in the driving transistor Tdr is charged in the reference line RL, and the sensing unit 236 generates a sensing data Sdata through an analog-to-digital conversion by sensing (or sampling) the voltage of the reference line RL.

The sensing data Sdata is supplied to the timing controller (not shown) of the organic light emitting display device, wherein the timing controller calculates a threshold voltage shift of the driving transistor Tdr on a basis of the sensing data Sdata of the pixel, and calculates compensation data for compensating the threshold voltage shift and then compensates the threshold voltage of the driving transistor Tdr through a data correction by correcting input data on a basis of the compensation data during the external compensation driving.

Unlike the internal compensation driving, the external compensation driving compensates the threshold voltage of the driving transistor Tdr by reflecting the threshold voltage of the driving transistor Tdr, which is based on the sensing data Sdata, in the data voltage to be supplied to the pixel, without compensating the threshold voltage of the driving transistor Tdr through sensing.

The pixel P according to external compensation driving of the first embodiment may include the data addressing period AP shown in FIG. 5A or FIG. 5C and the light emitting period EP shown in FIG. 5B.

The pixel P according to external compensation driving of the second embodiment may include the reset period t1 shown in FIG. 4A, the data addressing period AP shown in FIG. 5A or FIG. 5C, and the light emitting period EP shown in FIG. 5B.

During the data addressing period AP of the external compensation driving according to the first and second embodiments, the data voltage converted from the corrected data corrected based on the sensing data Sdata, that is, the data voltage that includes a compensation voltage for compensating the threshold voltage of the driving transistor Tdr is supplied to the corresponding data line.

Figure 7:
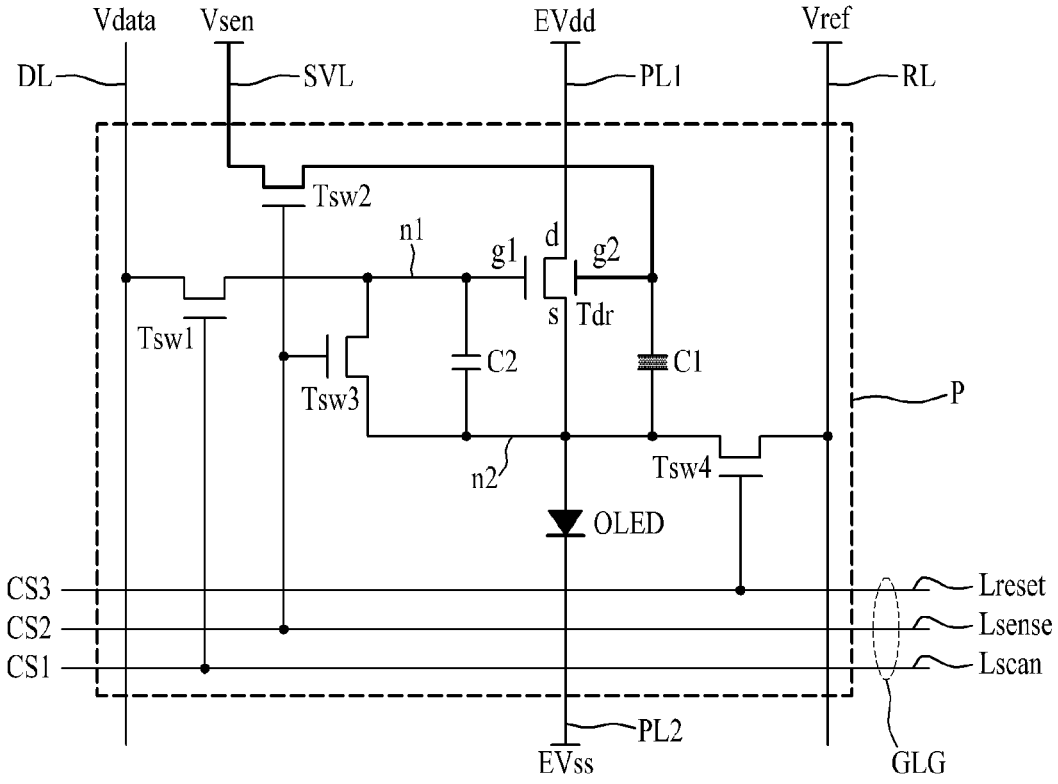
FIG. 7 is a diagram illustrating a structure of a pixel according to the second embodiment of the present invention.

FIG. 7 is a diagram illustrating a structure of a pixel according to the second embodiment of the present invention, wherein a sensing voltage line for supplying a sensing voltage is additionally provided in a second switching transistor.

As described above, in the pixel P according to the first embodiment of the present invention, the first electrode of the second switching transistor Tsw2 is connected to the data line DL and supplies the sensing voltage Vsen, which is supplied to the data line, to the second gate electrode g2 of the driving transistor Tdr in accordance with the sensing control signal CS2.

On the other hand, as illustrated in FIG. 7, in the pixel P according to the second embodiment of the present invention, a sensing voltage line SVL connected to the first electrode of the second switching transistor Tsw2 is additionally formed. The sensing voltage Vsen is externally, independently supplied to the sensing voltage line SVL.

Accordingly, the pixel P according to the second embodiment of the present invention may provide the same effect as that of the pixel P according to the first embodiment of the present invention. However, as compared with the pixel P according to the first embodiment, in case of the pixel P according to the second embodiment of the present invention, an aperture ratio is reduced as much as an area reserved by the sensing voltage line SVL, whereas voltage transition of a column driver (not shown), which supplies the data voltage Vdata and the sensing voltage Vsen to the data line DL, may be reduced, whereby power consumption may be reduced.

Figure 8:
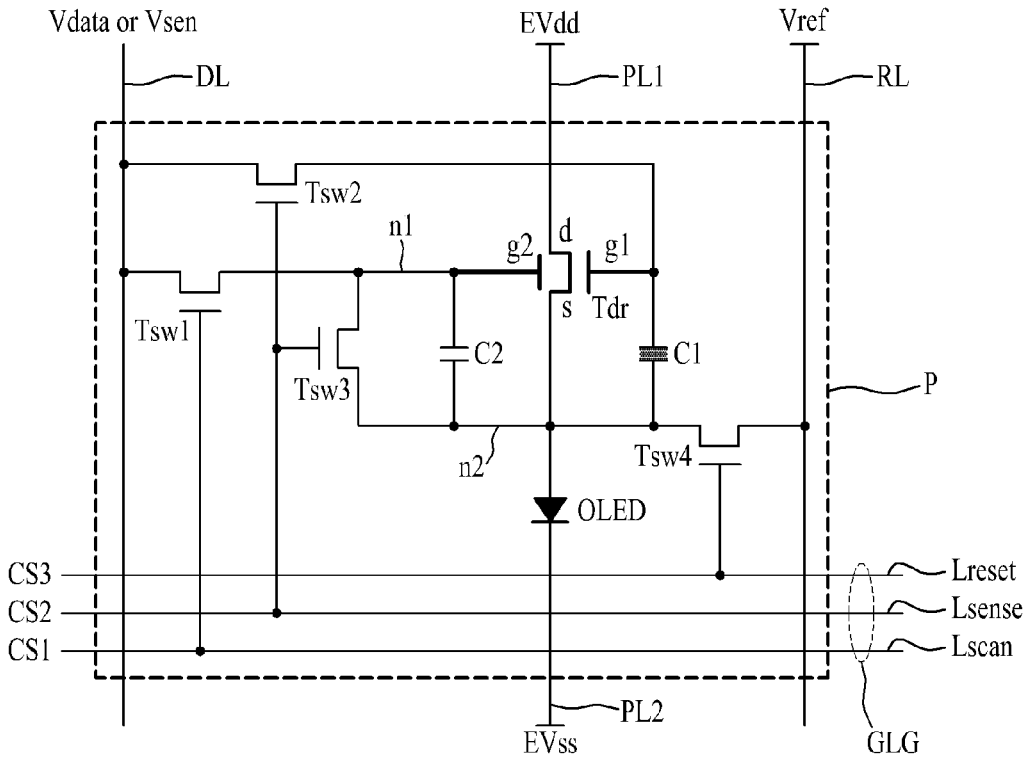
FIG. 8 is a diagram illustrating a structure of a pixel according to the third embodiment of the present invention.

FIG. 8 is a diagram illustrating a structure of a pixel according to the third embodiment of the present invention, wherein a connection structure of first and second gate electrodes of the driving transistor Tdr is changed. Hereinafter, only different elements will be described.

As described above, in the pixel P according to the first embodiment of the present invention, the first gate electrode g1 of the driving transistor Tdr is connected to the first and third switching transistors Tsw1 and Tsw3 and the second capacitor C2 through the first node n1, and the second gate electrode g2 of the driving transistor Tdr is connected to the second switching transistor Tsw2 and the first capacitor C1.

On the other hand, as illustrated in FIG. 8, in the structure of the pixel P according to the third embodiment of the present invention, positions of the first and second gate electrodes g1 and g2 of the driving transistor Tdr are exchanged. In other words, the first gate electrode g1 of the driving transistor Tdr is connected to the second switching transistor Tsw2 and the first capacitor C1, and the second gate electrode g2 of the driving transistor Tdr is connected to the first and third switching transistors Tsw1 and Tsw3 and the second capacitor C2 through the first node 1. In other words, the first gate electrode g1 is formed on the semiconductor layer, and the second gate electrode g2 is formed below the semiconductor layer to overlap the first gate electrode g1.

Since the first and second gate electrodes g1 and g2 of the driving transistor Tdr are formed to be overlapped with each other by interposing the semiconductor layer therebetween as illustrated in FIG. 3, even though the connection structure of the first and second gate electrodes g1 and g2 of the driving transistor Tdr is varied, the pixel P according to the third embodiment of the present invention is driven in the same manner as the pixel P of the first embodiment.

Additionally, the pixel P according to the third embodiment of the present invention may further include the sensing voltage line SVL as illustrated in FIG. 7. Accordingly, the pixel P according to the third embodiment of the present invention may provide the same effect as that of the pixel P of the first or second embodiment.

Figure 9:
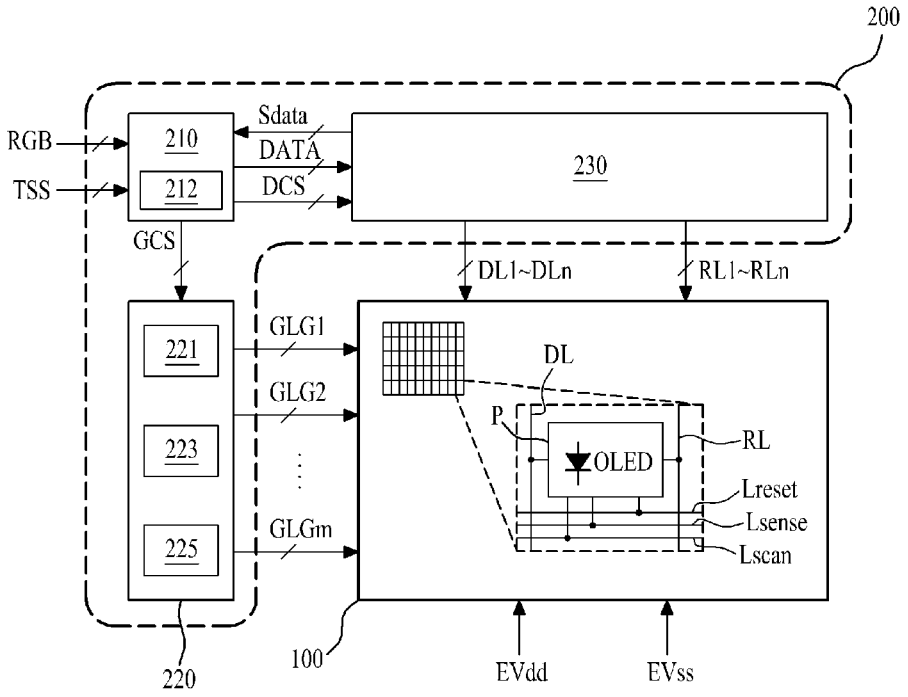
FIG. 9 is a diagram illustrating an organic light emitting display device according to an embodiment of the present invention.
Figure 10:
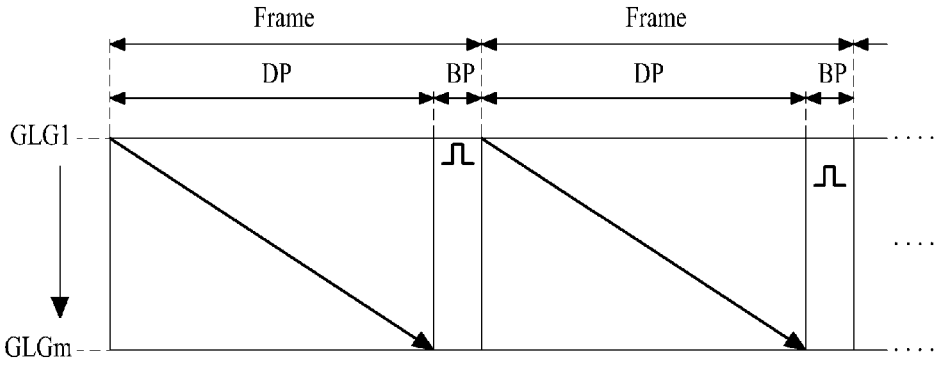
FIG. 10 is a diagram illustrating a driving of an organic light emitting display device according to an embodiment of the present invention.
Figure 11:
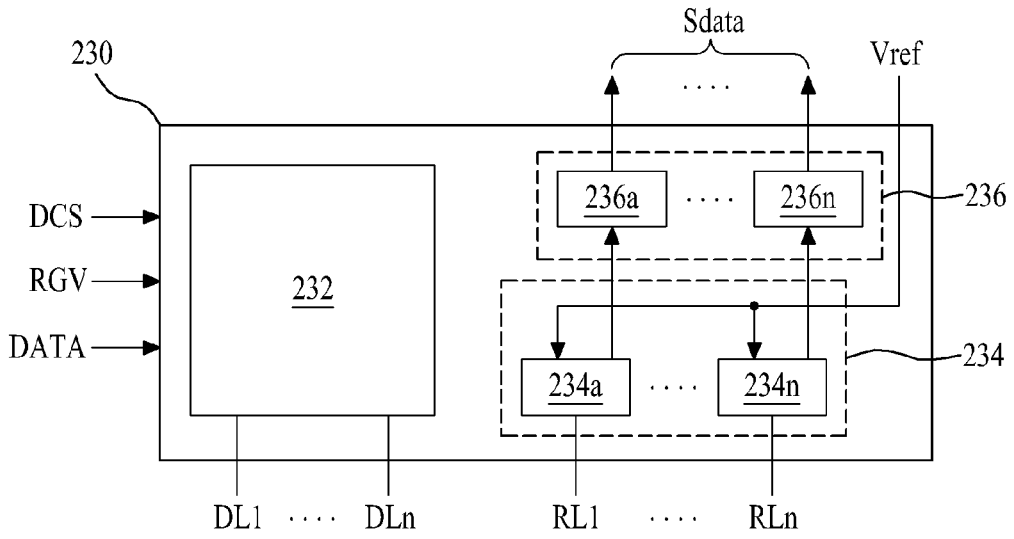
FIG. 11 is a diagram illustrating a column driver shown in FIG. 9.

FIG. 9 is a diagram illustrating an organic light emitting display device according to an embodiment of the present invention, FIG. 10 is a diagram illustrating a driving of an organic light emitting display device according to an embodiment of the present invention, and FIG. 11 is a diagram illustrating a column driver shown in FIG. 9.

Referring to FIGS. 9 to 11, the organic light emitting display device includes a display panel 100 and a panel driver 200.

The display panel 100 includes a plurality of data lines DL1 to DLn, a plurality of reference lines RL1 to RLn, a plurality of gate line groups GLG1 to GLGm, and a plurality of pixels P.

Each of the plurality of data lines DL1 to DLn is formed in parallel to have a constant interval along a first direction of the display panel 100, that is, a vertical direction.

Each of the plurality of reference lines RL1 to RLn is formed at a constant interval to be parallel with each of the plurality of data lines DL1 to DLn, and a reference voltage Vref having a constant direct current level is externally supplied thereto.

Each of the plurality of gate line groups GLG1 to GLGm is formed along a second direction of the display panel 100, for example, a horizontal direction to cross the data line DL. Each of the plurality of gate line groups GLG1 to GLGm includes a scan control line Lscan, a sensing control line Lsense, and a reset control line Lreset.

Additionally, the display panel 100 may further include a first driving power line PL1 connected to each pixel P, and a second driving power line PL2. The display panel 100 may further include the aforementioned sensing voltage line SVL as the case may be.

The first driving power line PL1 is connected to the pixel P formed to be parallel with the data line DL and connected to the pixel formed in a pixel row, and a high potential voltage EVdd is externally supplied thereto. The second driving power line PL2 is formed in wholly or a line type to be connected to the organic light emitting device, and a low potential voltage EVss is externally supplied thereto.

Each of the plurality of pixels P may be any one of a red pixel, a green pixel, a blue pixel and a white pixel. One unit pixel displaying one image may include a red pixel, a green pixel, a blue pixel and a white pixel, which are adjacent to one another, or may include a red pixel, a green pixel and a blue pixel. Since each of the plurality of pixels P has the pixel structure illustrated in FIG. 2, 7 or 8, its repeated description will be omitted.

As described above, the panel driver 200 operates each pixel P formed in the display panel 100 in an internal compensation mode or an external compensation mode.

An internal compensation driving of the internal compensation mode may be performed sequentially every horizontal line in a display period DP of each frame.

A threshold voltage sensing driving of the internal compensation mode or external sensing driving of the external compensation mode may be performed for the pixels P of at least one horizontal line every vertical blank period BP between frames as shown in FIG. 10. For example, if 1080 horizontal lines exist in the display panel 100, the threshold voltage sensing driving or the external sensing driving may be performed sequentially for one horizontal line every vertical blank period BP and may finally be performed for a total of 1080 during a frame period. In this case, the threshold voltage sensing driving or the external sensing driving may be performed for at least one horizontal line every vertical blank period BP to reduce switching duty of the switching transistors Tsw1 to Tsw4 per frame for the internal compensation mode or the external compensation mode to a very small range, whereby reliability of the switching transistors Tsw1 to Tsw4 may be improved.

Additionally, the external compensation mode may not be performed for only the vertical blank period BP but be performed sequentially for all the horizontal lines through a display period DP of at least one frame for a power on period of the organic light emitting display device, a power off period of the organic light emitting display device, a power on period after a set driving time or a power off period after the set driving time, or through the display period DP and the vertical blank period BP.

The panel driver 200 generates sensing data Sdata by sensing the threshold voltage of the driving transistor Tdr per pixel through each of the plurality of reference lines RL1 to RLn in the external compensation mode.

The panel driver 200 may include a timing controller 210, a gate driving circuit 220, and a column driver 230.

The timing controller 210 respectively generates a gate control signal GCS and a data control signal DCS for controlling the gate driving circuit 220 and the column driver 230 in the internal compensation mode or the external compensation mode on a basis of a timing synchronization signal TSS which is externally input.

For the threshold voltage sensing driving or internal compensation driving of the internal compensation mode, or the external sensing driving of the external compensation mode, the timing controller 210 generates pixel data DATA per pixel by aligning input data RGB, which are externally input, to match a pixel arrangement structure of the display panel 100, or generates sensing data DATA and provides the generated data to the column driver 230.

For the external compensation driving of the external compensation mode, the timing controller 210 calculates sensing compensation data per pixel, which are intended to compensate the threshold voltage of the driving transistor Tdr per pixel on a basis of the sensing data Sdata per pixel, which are provided from the column driver 230, calculates a deviation value by comparing the calculated compensation value per pixel with a previous compensation data per pixel, which are stored in a memory 212, generates compensation data per pixel by reflecting the calculated deviation value in such a way to add or subtract the calculated deviation value to or from the previous compensation data per pixel and stores the generated compensation data in the memory 212, and updates the compensation data per pixel, which are stored in the memory 212. Then, the timing controller 210 generates the pixel data DATA per pixel by correcting the input data RGB per pixel, which are externally input, in accordance with the compensation data per pixel, which are stored in the memory 212.

The gate driving circuit 220 generates control signals CS1, CS2 and CS3 as illustrated in FIG. 4*a*, 5*a*, 5*c* or 6*a* in response to the gate control signal GCS supplied from the timing controller 210 in accordance with a mode, and supplies the generated control signals to the control lines Lscan, Lsense and Lreset formed in the display panel 100.

The gate driving circuit 220 according to one example may include a scan line driver 221, a sensing line driver 223, and a reset line driver 225.

The scan line driver 221 is connected to the scan control line Lscan of each of the gate line groups GLG1 to GLGm. The scan line driver 221 generates the scan control signal CS1 as shown in FIG. 4*a*, 5*a*, 5*c* or 6*a* in response to the gate control signal GCS, and sequentially supplies the generated scan control signal to the scan control line Lscan of each of the gate line groups GLG1 to GLGm.

The sensing line driver 223 is connected to the sensing control line Lsense of each of the gate line groups GLG1 to GLGm. The sensing line driver 223 generates the sensing control signal CS2 as shown in FIG. 4*a*, 5*a*, 5*c* or 6*a* in response to the gate control signal GCS, and sequentially supplies the generated sensing control signal to the sensing control line Lsense of each of the gate line groups GLG1 to GLGm.

The reset line driver 225 is connected to the reset control line Lreset of each of the gate line groups GLG1 to GLGm. The reset line driver 225 generates the reset control signal CS3 as shown in FIG. 4*a*, 5*a*, 5*c* or 6*a* in response to the gate control signal GCS, and sequentially supplies the generated reset control signal to the reset control line Lreset of each of the gate line groups GLG1 to GLGm.

The gate driving circuit 220 may directly be formed on the display panel 100 together with the process of forming the thin film transistor of each pixel P or may be formed in the form of an integrated circuit IC, and then may be connected to one side of the control lines Lscan, Lsense, Lreset.

The column driver 230 is connected to each of the plurality of data lines DL1 to DLn and the plurality of reference lines RL1 to RLn, and is operated in the internal compensation mode or the external compensation mode in accordance with mode control of the timing controller 210 and supplies a data voltage Vdata (or sensing voltage Vsen) required for the corresponding mode to the corresponding data line DL.

If each pixel P is operated by the threshold voltage sensing driving while having the structure illustrated in FIG. 2 or 8, the column driver 230 generates the sensing voltage Vsen in accordance with sensing data and supplies the generated sensing voltage Vsen to the corresponding data line DL during the reset period t1 of FIG. 4A or the internal sensing period t2 of FIG. 4B. And, for the internal compensation driving, the column driver 230 performs a digital-to-analog conversion for the pixel data DATA per pixel to generate a data voltage Vdata for display, and supplies the generated data voltage Vdata to the corresponding data line DL during the data addressing period AP of FIG. 5A or the data addressing period AP of FIG. 5C. The column driver 230 according to one example for the threshold voltage sensing driving or the internal compensation driving may include a shift register (not shown), a latch unit (not shown), a grayscale voltage generator (not shown), and first to nth digital-to-analog converters (not shown).

The shift register sequentially outputs sampling signals using a source start signal and a source shift clock of the data control signal DCS by shifting the source start signal in accordance with the source shift clock. The latch unit latches input pixel data DATA by sequentially sampling the pixel data DATA in accordance with the sampling signals, and simultaneously outputs latch data corresponding to one horizontal line in accordance with a source output enable signal of the data control signal DCS. The grayscale voltage generator generates a plurality of grayscale voltages, which are different from one another and correspond to the number of grayscales of the pixel data DATA, by using a plurality of reference gamma voltages, which are externally input. Each of the first to nth digital-to-analog converters selects the grayscale voltage corresponding to the latch data from the plurality of grayscale voltages supplied from the grayscale voltage generator, as a data voltage Vdata and outputs the selected voltage to the corresponding data lines DL1 to DLn.

For the external sensing driving, the column driver 230 generates the sensing voltage Vsen in accordance with sensing data, and generates sensing data Sdata by sensing the threshold voltage of the driving transistor Tdr per pixel through the reference line RL during the external sensing period t2 of FIG. 6B while supplying the generated sensing voltage Vsen to the corresponding data line DL during the reset period T1 of FIG. 6A or the external sensing period t2 of FIG. 6B, and supplies the generated sensing data to the timing controller 210. For the external compensation driving, the column driver 230 converts the pixel data DATA per pixel, which are supplied from the timing controller 210, to the data voltage Vdata for display and then supplies the converted voltage to the corresponding data line DL during the data addressing period. The column driver 230 according to another example for the external sensing driving and the external compensation driving includes a data driver 232, a switching unit 234 and a sensing unit 236 as illustrated in FIG. 11.

The data driver 232 converts the pixel data DATA (or sensing data) for display, which are supplied from the timing controller 210, to the data voltage Vdata in response to the data control signal DCS supplied from the timing controller 210 in accordance with the internal compensation mode or the external compensation mode and then supplies the converted voltage to the corresponding data lines DL1 to DLn. The data driver 232 may include a shift register, a latch unit, a grayscale voltage generator, and first to nth digital-to-analog converters as described above.

The switching unit 234 may supply the reference voltage Vref to the reference line RL or connect the reference line RL to the sensing unit 236 in response to the a switching control signal (not shown) supplied from the timing controller 210, or may connect the reference line RL to the sensing unit 236 after floating the reference line RL for a constant time. In other words, the switching unit 234 supplies the reference voltage Vref to the reference line RL during the reset period T1 shown in FIG. 6A for the external compensation mode. Also, the switching unit 234 may connect the reference line RL to the sensing unit 236 during the external sensing period t2 shown in FIG. 6*b*, or may connect the reference line RL to the sensing unit 236 after floating the reference line RL for a constant time. To this end, the switching unit 234 may include a plurality of selectors 234*a* to 234*n* connected to each of the plurality of reference lines RL1 to RLn and the sensing unit 236, wherein the selectors 234*a* to 234*n* may be comprised of multiplexers.

The sensing unit 236 is connected to the plurality of reference lines RL1 to RLn through the switching unit 234 and senses a voltage of each of the plurality of reference lines RL1 to RLn for the external compensation mode, that is, during the external sensing period t2 shown in FIG. 6B, and generates sensing data Sdata corresponding to the sensing voltage and provides the generated sensing data to the timing controller 210. To this end, the sensing unit 236 may include a plurality of analog-to-digital converters 236*a* to 236*n*, which are connected to the plurality of reference lines RL1 to RLn through the switching unit 234 and perform an analog-to-digital conversion for the sensing voltage to generate the sensing data Sdata.

The organic light emitting display device according to an embodiment of the present invention may selectively drive the pixel in accordance with the internal compensation mode or the external compensation mode through switching of four switching transistors Tsw1 to Tsw4. In other words, the threshold voltage of the driving transistor Tdr is stored in the first capacitor C1 in accordance with switching of the four switching transistors Tsw1 to Tsw4, whereby the threshold voltage of the driving transistor Tdr may be compensated in accordance with the internal compensation mode. In this case, as the organic light emitting device OLED emits light while the threshold voltage of the driving transistor Tdr, which is stored in the first capacitor C1, is being continuously maintained, degradation of the switching transistors Tsw1 to Tsw4 for compensation of the driving transistor Tdr may be reduced, whereby reliability and lifespan may be increased. Also, the threshold voltage of the driving transistor Tdr may be sensed externally in accordance with switching of the four switching transistors Tsw1 to Tsw4, and may be compensated in accordance with the external compensation mode through data correction, whereby threshold voltage deviation of the driving transistor Tdr between the pixels may be compensated exactly. As a result, picture quality may be improved.

According to an embodiment of the present application, the threshold voltage of the driving transistor may be sensed and then stored in the capacitor, and the organic light emitting device OLED emits light while the threshold voltage of the driving transistor, which is stored in the capacitor, is being continuously maintained, whereby degradation of the switching transistors for compensation of the driving transistor may be reduced. As a result, reliability and lifespan may be increased.

Also, the threshold voltage of the driving transistor may be sensed externally, and may be compensated in accordance with the external compensation mode through data correction, whereby threshold voltage deviation of the driving transistor among the pixels may be compensated. As a result, picture quality may be improved.

Moreover, a variation of driving characteristics of the driving transistor included in the pixel may be compensated selectively in accordance with the internal compensation mode and the external compensation mode.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic light emitting display device, comprising:

a display panel having a plurality of pixels, each pixel connected to a data line, a gate line group and a reference line, each pixel further including:

an organic light emitting device;

a driving transistor controlling a current flowing in the organic light emitting device and including first and second gate electrodes overlapped with each other, with a semiconductor layer provided therebetween;

a first switching transistor selectively supplying a data voltage supplied to the data line to a first node connected to the first gate electrode;

a second switching transistor selectively supplying a sensing voltage to the second gate electrode;

a third switching transistor selectively connecting a second node connected to a source electrode of the driving transistor to the first node;

a fourth switching transistor selectively connecting the reference line to the second node;

a first capacitor connected between the second gate electrode and the second node, the first capacitor storing a threshold voltage of the driving transistor; and a second capacitor connected between the first and second nodes, the second capacitor storing a difference voltage of the first and second nodes.

2. The organic light emitting display device of claim 1, wherein the pixel is driven for a reset period and an internal sensing period in accordance with threshold voltage sensing driving, for the reset period, voltages of the first and second nodes are reset to a reference voltage supplied to the reference line, and the first capacitor is reset by a difference voltage of a sensing voltage supplied to the second gate electrode and a reference voltage supplied from the reference line to the second node, and for the internal sensing period, the driving transistor is driven in a source follower mode by the sensing voltage supplied to the second gate electrode, and the first capacitor stores the threshold voltage of the driving transistor in accordance with driving of the driving transistor.

3. The organic light emitting display device of claim 2, wherein the first switching transistor is turned off during the reset period and the internal sensing period, the second and third switching transistors are turned on during the reset period and the internal sensing period, and the fourth switching transistor is turned on during the reset period only.

4. The organic light emitting display device of claim 3, wherein the threshold voltage sensing driving is performed during a vertical blank period.

5. The organic light emitting display device of claim 2, wherein each pixel is driven during a data addressing period and a light emitting period in accordance with an internal compensation driving, during the data addressing period, the second capacitor stores a difference voltage between a data voltage supplied to the first node and a reference voltage supplied from the reference line to the second node, and during the light emitting period, the driving transistor is driven in accordance with voltages of the first and second capacitors, and supplies a current determined by the difference voltage between the data voltage and the reference voltage to the organic light emitting device.

6. The organic light emitting display device of claim 5, wherein the first and fourth switching transistors are turned on during the data addressing period only, and the second and third switching transistors are turned off during the data addressing period and the light emitting period.

7. The organic light emitting display device of claim 6, wherein the fourth switching transistor is turned off during the data addressing period simultaneously with the first switching transistor, or turned off earlier than the first switching transistor as much as a time difference which is set.

8. The organic light emitting display device of claim 1, further comprising a sensing unit generating sensing data by sensing the threshold voltage of the driving transistor through the reference line, wherein each pixel is driven during a reset period and an external sensing period in accordance with an external sensing driving, during the reset period, voltages of the first and second nodes are reset to a reference voltage supplied to the reference line, and the first capacitor is reset by a difference voltage between a sensing voltage supplied to the second gate electrode and a reference voltage supplied from the reference line to the second node, and during the external sensing period, the driving transistor is driven in a source follower mode by the sensing voltage supplied to the second gate electrode, and the sensing unit generates sensing data by sensing the threshold voltage of the driving transistor based on driving of the driving transistor through the reference line.

9. The organic light emitting display device of claim 8, wherein the first switching transistor is turned off and the second to fourth switching transistors are turned on during external compensation driving of the pixel, and the reference line is connected to the sensing unit after being floated for a constant time between the reset period and the external sensing period.

10. The organic light emitting display device of claim 8, wherein each pixel is driven during a data addressing period and a light emitting period in accordance with external compensation driving, during the data addressing period, the second capacitor stores a difference voltage of a data voltage corrected on the basis of the sensing data and supplied to the first node and a reference voltage supplied from the reference line to the second node, and during the light emitting period, the driving transistor is driven in accordance with voltages of the first and second capacitors, and supplies a current determined by the difference voltage of the data voltage and the reference voltage to the organic light emitting device.

11. The organic light emitting display device of claim 8, wherein each pixel is driven during a reset period, a data addressing period and a light emitting period in accordance with external compensation driving, during the reset period, voltages of the first and second nodes are reset to a reference voltage supplied to the reference line, during the data addressing period, the second capacitor stores a difference voltage of a data voltage corrected on the basis of the sensing data and supplied to the first node and a reference voltage supplied from the reference line to the second node, and during the light emitting period, the driving transistor is driven in accordance with voltages of the first and second capacitors, and supplies a current determined by the difference voltage of the data voltage and the reference voltage to the organic light emitting device.

12. The organic light emitting display device of claim 1, wherein the first gate electrode is formed below the semiconductor layer, and the second gate electrode is formed on the semiconductor layer to overlap the first gate electrode.

13. An organic light emitting display device including a pixel connected to a data line, a gate line group and a reference line, the pixel comprising:

an organic light emitting device;

a driving transistor controlling a current flowing in the organic light emitting device and including first and second gate electrodes overlapped with each other by interposing a semiconductor layer therebetween;

a first capacitor connected between the second gate electrode and a source electrode of the driving transistor;

a second capacitor connected between the first gate electrode and the source electrode; and a switching unit switched in accordance with a control signal supplied to the gate line group, storing a threshold voltage of the driving transistor in the first capacitor, storing a difference voltage of a data voltage supplied to the data line and a reference voltage supplied to the reference line in the second capacitor, and allowing the light emitting device to emit light by driving the driving transistor through voltages of the first and second capacitors.

14. The organic light emitting display device of claim 13, wherein the switching unit includes:

a first switching transistor selectively supplying the data voltage supplied to the data line to a first node connected to the first gate electrode;

a second switching transistor selectively supplying a sensing voltage to the second gate electrode;

a third switching transistor selectively connecting a second node connected to the source electrode of the driving transistor to the first node; and a fourth switching transistor selectively connecting the reference line to the second node.

15. A method for driving an organic light emitting display device including a pixel, the pixel including an organic light emitting device, a driving transistor controlling a current flowing in the organic light emitting device and including first and second gate electrodes overlapped with each other, with a semiconductor layer provided therebetween, a first capacitor connected between the second gate electrode and a source electrode of the driving transistor, and a second capacitor connected between the first gate electrode and the source electrode, the method comprising the steps of:

(A) storing a threshold voltage of the driving transistor in the first capacitor;

(B) storing a difference voltage between a data voltage supplied to a data line and a reference voltage supplied to a reference line in the second capacitor; and (C) allowing the organic light emitting device to emit light by driving the driving transistor through voltages of the first and second capacitors.

16. The method of claim 15, wherein the step (A) includes:

resetting the second capacitor by supplying the reference voltage to each of the first gate electrode and the source electrode while storing a difference voltage of a sensing voltage and the reference voltage in the first capacitor by supplying the sensing voltage to the second gate electrode and supplying the reference voltage to the source electrode; and storing the threshold voltage of the driving transistor in the first capacitor by driving the driving transistor in a source follower mode in accordance with the sensing voltage.

17. The method of claim 15, wherein the step (B) includes:

supplying the data voltage to the first gate electrode; and supplying the reference voltage to the source electrode, and the data voltage supplied to the first gate electrode and the reference voltage supplied to the source electrode are turned off at the same time or the reference voltage is turned off earlier than the data voltage.

18. A method for driving an organic light emitting display device including a pixel, the pixel including an organic light emitting device, a driving transistor controlling a current flowing in the organic light emitting device and including first and second gate electrodes overlapped with each other by interposing a semiconductor layer therebetween, a first capacitor connected between the second gate electrode and a source electrode of the driving transistor, and a second capacitor connected between the first gate electrode and the source electrode, the method comprising the steps of:

(A) resetting the second capacitor by supplying a reference voltage to each of the second gate electrode and the source electrode through a reference line and storing a difference voltage of a sensing voltage and the reference voltage in the first capacitor by supplying the sensing voltage to the first gate electrode; and (B) generating sensing data by sensing the threshold voltage of the driving transistor through the reference line while driving the driving transistor in a source follower mode in accordance with the sensing voltage.

19. The method of claim 18, further comprising the steps of:

(C) generating pixel data by correcting data, which will be supplied to the pixel, on the basis of the sensing data;

(D) supplying the reference voltage to the source electrode, converting the pixel data to a data voltage and supplying the converted voltage to the first gate electrode, and storing the voltage in the second capacitor; and (E) allowing the organic light emitting device to emit light by driving the driving transistor through the voltage of the second capacitor.

20. The method of claim 19, wherein, at the step (D), the reference voltage supplied to the source electrode and the data voltage supplied to the first gate electrode are turned off at the same time or the reference voltage is turned off earlier than the data voltage.

* * * * *